US006206361B1

(12) United States Patent
Geldmeier

(10) Patent No.: US 6,206,361 B1
(45) Date of Patent: Mar. 27, 2001

(54) DEVICE FOR SEPARATING BLANKS

(75) Inventor: Gunter Geldmeier, Stemwede (DE)

(73) Assignee: Kolbus GmbH & Co. KG, Rahden (DE)

( * ) Notice: Subject to any disclaimer, the term of this patent is extended or adjusted under 35 U.S.C. 154(b) by 0 days.

(21) Appl. No.: 09/320,321

(22) Filed: May 26, 1999

(30) Foreign Application Priority Data

May 27, 1998 (DE) ..... 198 23 649

(51) Int. Cl.[7] ..... B65H 3/44; B65H 5/26

(52) U.S. Cl. ..... 271/9.12; 271/11; 271/94; 271/98; 271/100; 271/101; 271/102; 271/106; 271/171

(58) Field of Search ..... 271/11, 12, 16, 271/20, 94, 98, 100, 101, 102, 106, 9.02, 9.12, 171

(56) References Cited

U.S. PATENT DOCUMENTS

| | | | | |
|---|---|---|---|---|
| 2,869,867 | * | 1/1959 | Backhouse | 271/12 |
| 3,586,316 | * | 6/1971 | Ehlscheid | 271/101 |
| 4,132,398 | * | 1/1979 | Erdmann et al. | 271/12 |
| 5,295,676 | * | 3/1994 | Kenin et al. | 271/99 |

FOREIGN PATENT DOCUMENTS

| | | | | |
|---|---|---|---|---|
| 1258424 | | 1/1967 | (DE) . | |
| 76 17 938 | | 6/1976 | (DE) . | |
| 77 17 313 U1 | | 1/1977 | (DE) | B65H/3/48 |
| 40 21 444 A1 | | 5/1990 | (DE) | B65H/7/24 |
| 42 18 203 A1 | | 3/1992 | (DE) | B65H/3/08 |
| 42 41 855 A1 | | 11/1992 | (DE) | B65H/3/48 |
| 195 16 047 C2 | | 4/1995 | (DE) | B26D/1/09 |
| 196 16 047 A1 | | 4/1996 | (DE) | B65H/39/04 |
| 0067435 | * | 4/1982 | (JP) | 271/11 |
| 0295944 | * | 12/1986 | (JP) | 271/102 |
| 406227690A | * | 8/1994 | (JP) | 271/9.12 |

OTHER PUBLICATIONS

German Search Report For Application 198 23 649.2.

* cited by examiner

*Primary Examiner*—H. Grant Skaggs
(74) *Attorney, Agent, or Firm*—Alix, Yale & Ristas, LLP

(57) ABSTRACT

A device for continuous separation of blanks for book cover material, envelopes for brochures or similar bendable sheets of a stack of sheets from a magazine with a conveyor belt with a non-skid surface and openings acted upon by air suction, bearing the stack of sheets, feeding the lowest sheet in each case in timed fashion from the magazine, which has a suction element grasping the lowest sheet and removing it from the stack of sheets, with an air blower for creating an air cushion between the raised sheet and the following sheet and with a removal conveyor system receiving and further transporting the sheet fed with respect to a functionally reliable separation of large-format flexible sheets is characterized by supports (17, 18) on both sides of an open space supporting a stack of sheets (1) in the edge area and by a suction element (14) capable of being driven under the stack of sheets (1), grasping a sheet **(1*a*) in the open space in the edge area, and pulling down from the stack of sheets (1) in order to create an indentation (21) in the sheet (1*a*), opened to the edge of the sheet (1*a*), drawn inwards around the supports (17, 18), in order to introduce blown air via an air blower (16)**.

24 Claims, 4 Drawing Sheets

DEVICE FOR SEPARATING BLANKS

BACKGROUND OF THE INVENTION

The invention concerns a device for continuous separation of blanks for book cover material, covers for brochures or similar bendable sheets of a stack of sheets. A stack of sheets is disposed in a magazine in which a conveyor belt supports the stack of sheets. The device feeds the lowest of the stack of sheets periodically from the magazine, the device uses a high friction (skid-proof) surface and openings through which air is sucked, with a suction element grasping the lowest sheet and lifting it from the stack of sheets. The device also includes a blower device for creating an air cushion between the lifted sheet and the sheet next to the bottom sheet of the stack of sheets. The device also includes a removal conveyor system for receiving and further transporting successive sheets as they are removed from the bottom of the stack of sheets.

Patent Application DE 196 16 047 having the same assignee as the present application concerns a device for separating folded sheets for collecting machines, with a magazine for receiving a stack of folded sheets, from which the respectively lowest folded sheet is fed from a time-controlled conveyor belt with a non-skid surface and openings capable of being acted upon by air suction, and grasping the folded sheets in the front area of the folded edge. The width of the conveyor belt forming the bottom of the magazine is reduced with respect to the width of the magazine, so that the rear area of the folded sheets projects over the conveyor belt. The folded sheet is tipped over a suction element grasping the lowest folded sheet in the forward open folded edge area, and creates an air cushion intermediate the lowest folded sheet and the second lowest folded sheet, in order to separate the lowest folded sheet. The air blower can be inserted into the opening slot thus formed so that, on the one hand, separating air is brought onto the sliding plane of the folded sheets, and on the other hand the stacked folded sheets are supported in the rear area projecting over the conveyor belt. A conveyor system in the form of delivery rollers and counter-pressure rollers for receiving and removing the folded sheets fed by the conveyor belt from the stack of folded sheets is located after the conveyor belt.

The task of the invention consists in creating a device for separating blanks for book cover material, envelopes for brochures or similar bendable sheets of a stack of sheets from a magazine of the usual design, which makes a reliable separation of large-format flexible sheets possible. In addition, the arrangement for adjusting the middle of the length of the sheets should be suited as a reference midline.

The task is solved by the apparatus in accordance with claim 1 of this application. Further advantageous embodiments are indicated in the other claims.

An air cushion between the lowest and second-lowest sheet can be intentionally created over the indentation, in the edge area of the sheet to be separated, opened toward the edge of the sheet. By blowing air into this limited area an uncontrolled deviation of blown air is avoided and only a relatively small amount of air is required. The sheets are located with their edge area in a fixed position, so that even materials with a low inherent rigidity are grasped reliably by the suction element. As a result of the indentation the lowest sheet is released from the stack of sheets and at the same time a relative displacement directed inward to the following sheet takes place, by means of which the so-called suction plate effect is avoided. The suction element gets by with a low suction force, which excludes the danger of sucking through and thus double removal.

BRIEF DESCRIPTION OF THE DRAWING

A preferred embodiment of the invention will be better understood by reference to the accompanying drawing in which.

DESCRIPTION OF THE PREFERRED EMBODIMENTS

Figure 1:
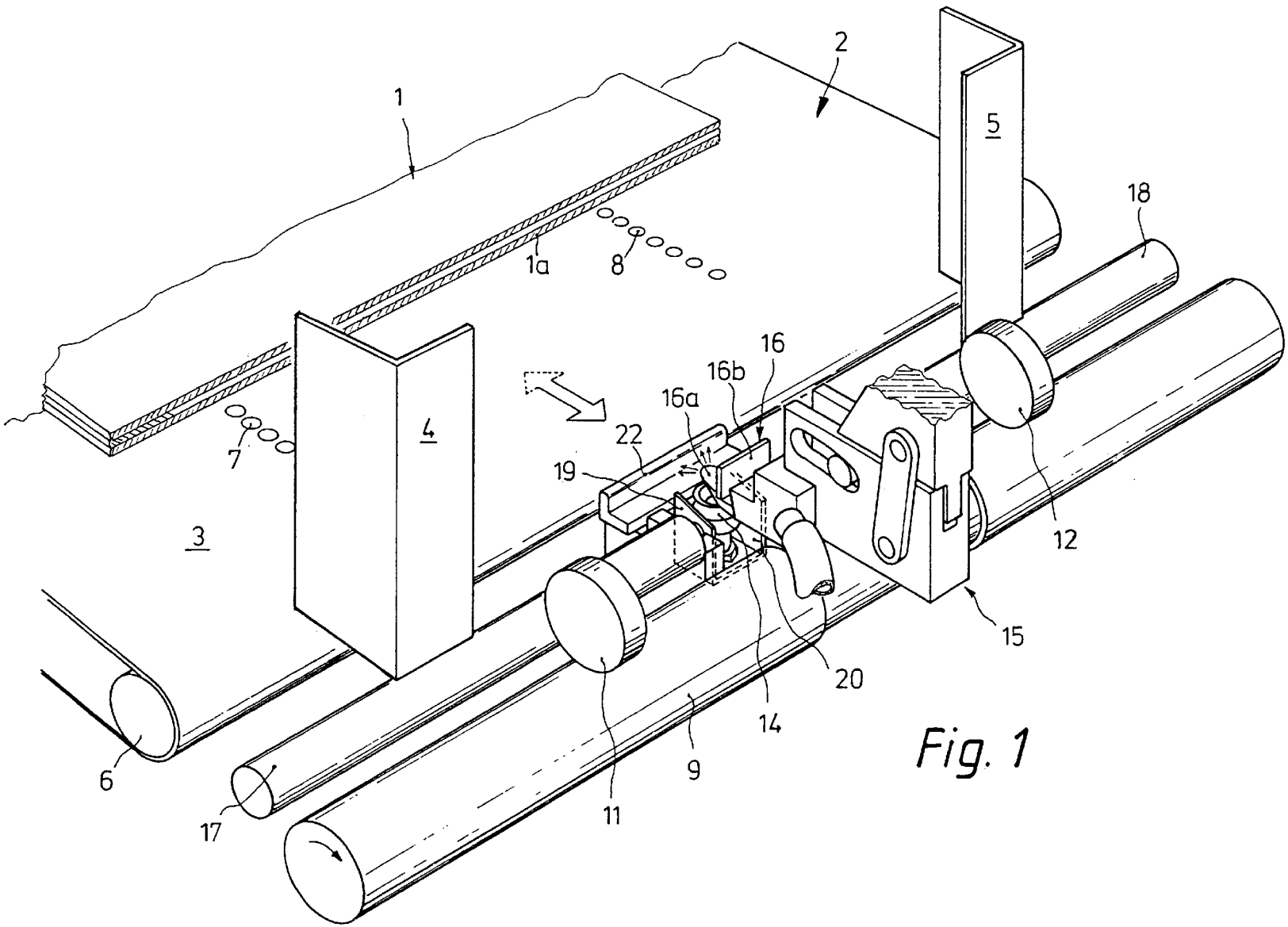
FIG. 1 shows the front part of a device for continuous separation of blanks for book covering material in a perspective view.

FIG. 1 shows a magazine 2 for receiving stacked blanks 1 for book cover material with a conveyor belt 3 forming the bottom of the magazine and with forward angle plates 4 and 5 making it possible for the blanks 1 to be conveyed to pass through. The conveyor belt 3 is a belt capable of running forward and backwards in cycles guided around a guide roller, with a non-skid surface, and in its forward area it has two rows of holes 7 and 8 connected to a source of air suction. The lowest blank 1*a* in the stack of blanks 1 at any given instant is carried with the timed advance of the conveyor belt 3 via the friction force applied by the conveyor belt 3 in connection with the suction air and transferred to a delivery system in the form of delivery rollers 9 with spring-mounted counter-pressure rollers 11 and 12, driven constantly and at a higher speed, located immediately after the conveyor belt 3.

After the successful receipt of the lowest blank 1*a* by the removal conveyor system 9 and 11, 12, the conveyor belt 3 returns to its initial position for feeding the next blank to reach the bottom of the stack of blanks 1. An air cushion is then created between the conveyor belt 3 and the stack of blanks 1 from the holes 7 and 8, which are also are in a guiding connection with an air source, by means of switching on the air blast in a timed fashion, in order to reduce the friction. The stack of blanks is prevented from sliding back here by means of the installation of back stops (not shown).

In order to create an air cushion between the blank 1*a* and the stack of blanks 1 at the time of feeding the blank 1*a* to be separated, in the front middle edge area of the stack of blanks 1, as seen in the direction of removal, there is a suction device 14, capable of moving in the vertical plane, grasping the lowest blank 1*a*, and removing it from the stack of blanks 1, with a suction cup and a bellows and further an air blower 16, with a nozzle 16*a* and a stop 16*b* for supporting the stack of blanks 1, capable of moving via a cam-controlled swivel mechanism 15 into the plane between the lowest blank 1*a* and the stack of blanks 1.

For different format widths of the blanks 1 the angle plates 4 and 5 can be adjusted toward the middle length of the magazine 2 as reference midline.

The suction device 14 and the air blower 16 are located in an open space between freely rotatable support rollers 17 and 18 supporting the stack of blanks 1 in the edge area in a plane at the same height as the conveyor belt 3 and the removal roller 9.

On both sides of the suction device 14 there are supporting plates 19 and 20 provided passing at a right angle to the edge of the blank 1*a* and dropping downward to which the suction cup of the suction device 14 is relatively movable in order to create an indentation 21 drawn inwards around the support rollers 17 and 18 as well as around the supporting plates 19 and 20, opened to the edge of the blank 1, by drawing the bellows of the suction device 14 together telescopically at the time of building up the under-pressure.

In order to increase the angle between the lowest blank 1*a* lifted by the suction device 14 and the stack of blanks 1 to achieve an increase in the functional reliability at the time of introducing the air blower 16, a stack lifter 22 is provided which lifts the stack of blanks 1 over the plane of motion in the area directly behind the indentation 21 at the same time as the suction device 14 moves downward.

The separation of blanks 1*a* for book cover material is to be explained below in the sequential phases of motion by means of FIGS. 2*a–c*.

Figure 2A:
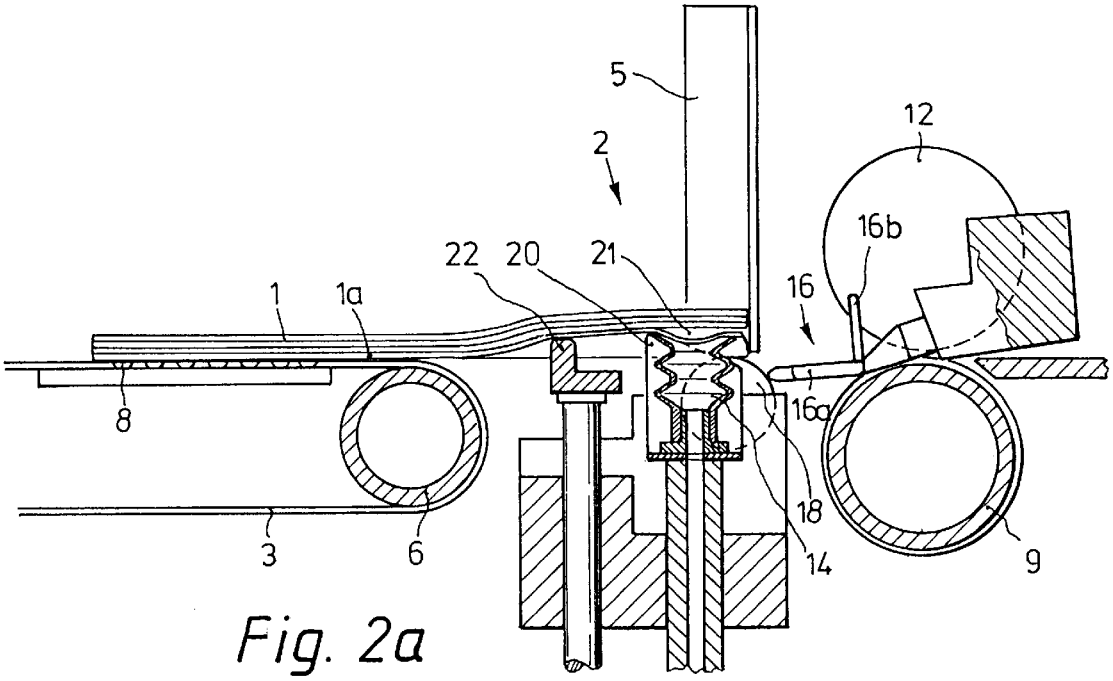
FIGS. 2*a–c* shows the front part of the device in a longitudinal section in the sequential phases of motion.

In FIG. 2*a* the suction device 14 is disposed at the highest elevation in the operational cycle thereof. The suction device 14 is positioned under the forward middle edge area of the stack of blanks 1. At the time the stack of blanks 1 is raised over the plane of motion (defined by the conveyor belt 3), and the lowest blank 1*a* is grasped by the suction device 14. In addition, the stack lifter 22 moves in the vertical plane under the stack of blanks 1 at a distance from the front edge of the stack of blanks 1 in order to raise the stack of blanks 1 over the plane of motion into a position at approximately the same level as the suction device 14.

Figure 2B:
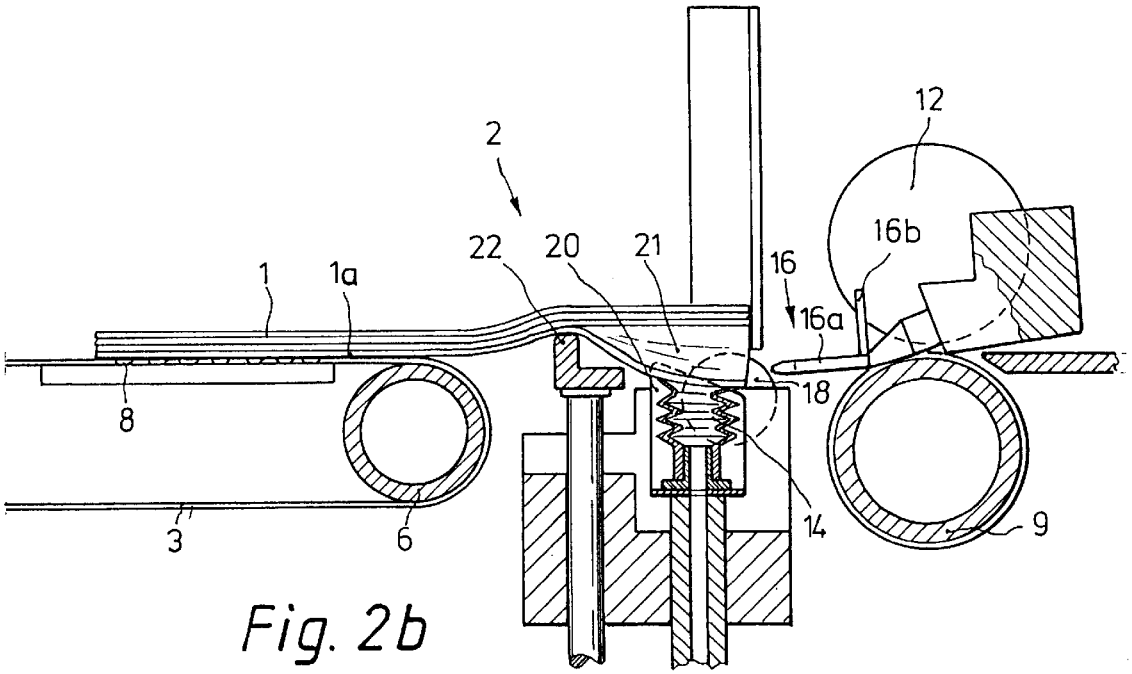

FIG. 2*b* shows the suction device 14 with the blanks 1*a* raised from the stack of blanks 1 in its lower end position, an indentation 21 opened to the edge of the blank 1*a*, drawn inward around the supporting plates 19 and 20, arising as a result of the bellows drawing together telescopically because of the suction.

Figure 2C:
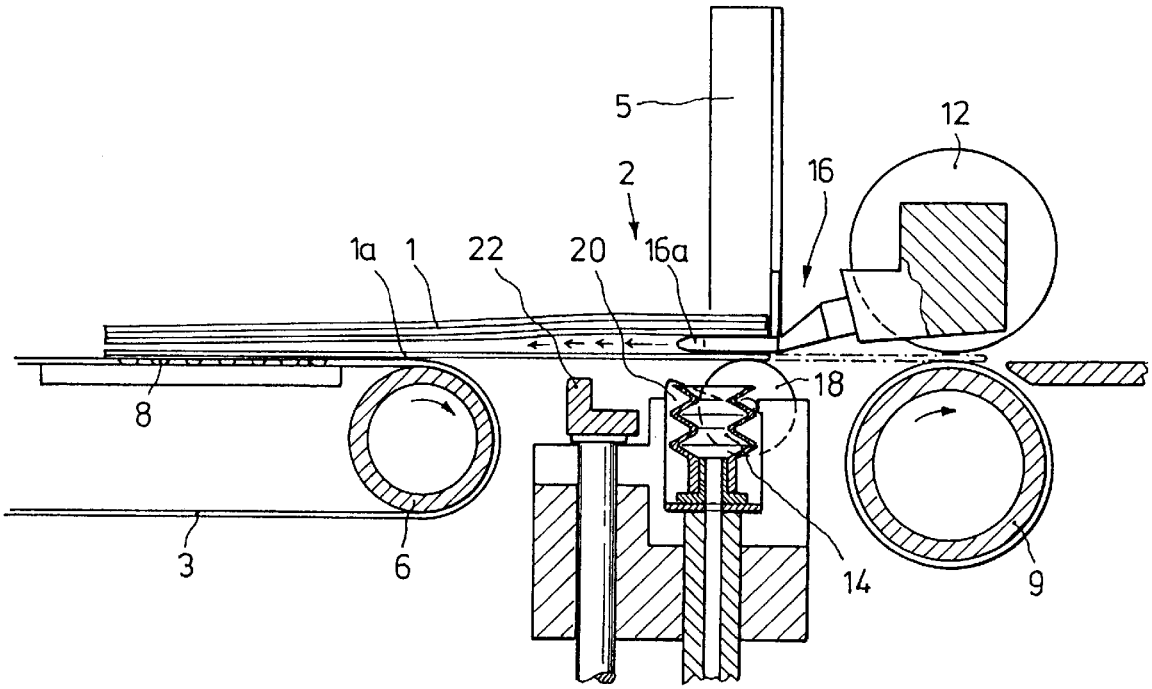

FIG. 2*c* shows the air blower 16, driven via the curve-controlled swivel mechanism 15 between the raised lowest blank 1*a* and the stack of blanks 1, via which a controlled air cushion is created with the timed feeding of the blank 1*a* by the conveyor belt 3 over the support rollers 17 and 18, starting from the indentation 21, in order to reduce the friction between the blank 1*a* and the stack of blanks 1.

The invention is not limited to the specific embodiment shown and described and numerous modifications are permitted without departing from the framework of the invention.

Figure 3:
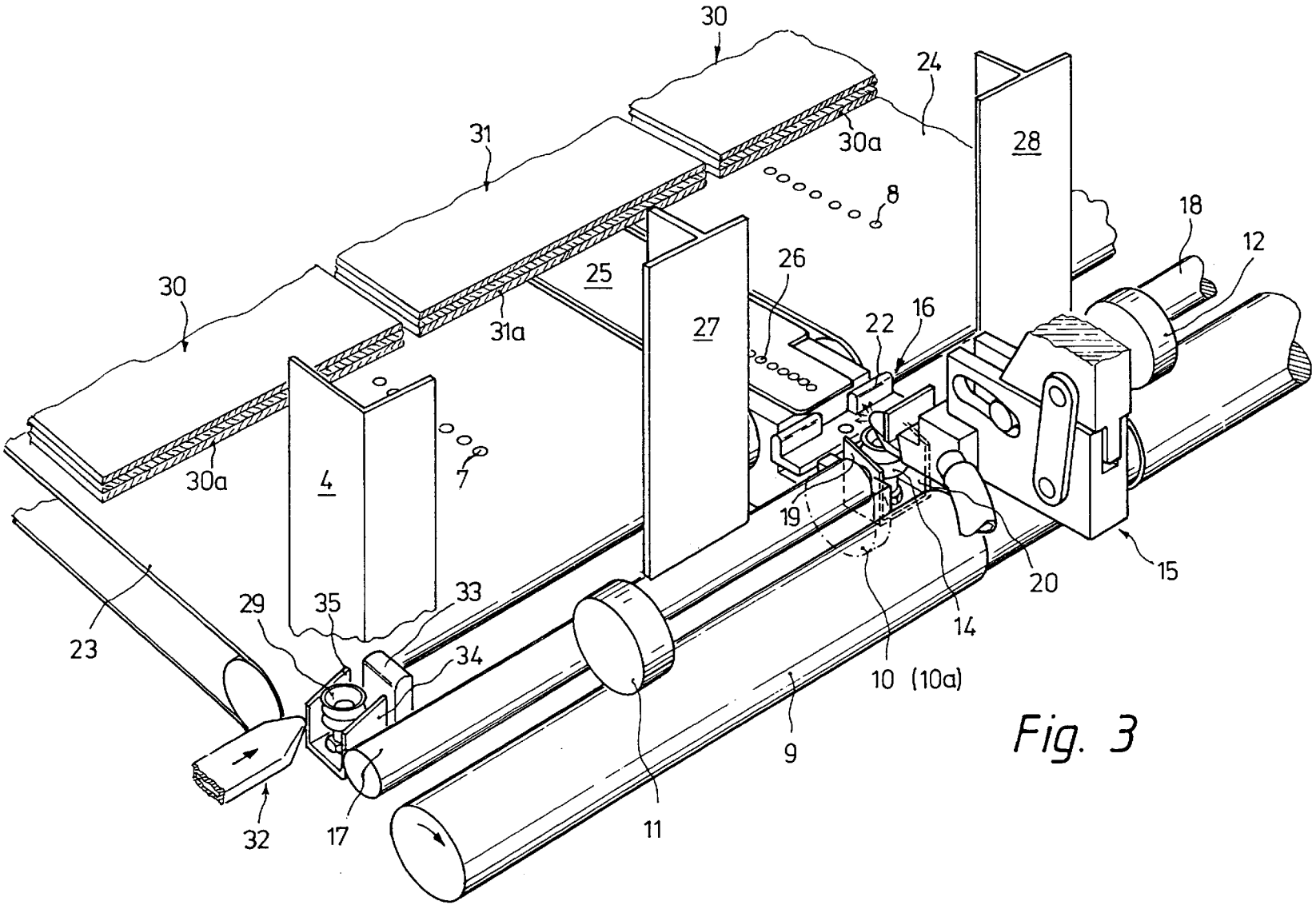
FIG. 3 shows the device in a modified design in a perspective view.

As is shown in FIG. 3, in order to process three-part blanks 30 and 31 for book cover material, the conveyor belt 3 forming the bottom of the magazine can be made out of two belts 23 and 24 and a slider 25, capable of moving back and forth between the belts in synchrony with the belts 23 and 24, with holes 26, which are in a guiding connection with a source of air suction and blowing. In each case angle plates 4, 5, 27, 28 are associated with the two belts 23 and 24 as well as the slider 25. While a suction device 14 with supporting plates 19 and 20, an air blower 16 with a stack lifter 22, acting on the from edge area is used for separating the blanks 31*a* from the stack of blanks 31, a suction device 29 with supporting plates 34 and 35 acting on the two belts 23 and 24 on the side edge area of the stack of blanks 30 as seen in the direction of motion, and air blowers 32 as well as stack lifters 33 capable of being driven from the side between the lowest blank 30*a* and the stack of blanks 30 are located in the open spaces between conveyor belt 23 and supporting roller 17 and conveyor belt 24 and supporting roller 18 in order to create indentations opened to the edge and drawn inward for the introduction of blown air for separating the lowest blank 30*a* from the stack of blanks 30 onto the two belts 23 and 24. The blanks 30*a* and 31*a* fed in timed fashion by the slider 25 and the two belts 23 and 24 then are received by the removal conveyor system, which is formed by the removal roller 9 with counter-pressure rollers 11 and 12, as well as by further counter-pressure rollers 10 and 10*a* for the middle blank 31, and further transported at a higher speed.

What is claimed is:

1. A device for continuing separation of blanks for book cover material, envelopes for brochures and similar bendable sheets from associated stacked sheets which comprises:

a magazine dimensioned and configured for holding an associated first stack of sheets, said magazine including a first conveyor belt on which the associated first stack of sheets rests in normal operation of the device;

said device including means for feeding the lowest sheet from the first stack of sheets in the magazine in a timed fashion, said means for feeding including a non-skid surface on said conveyor belt and a plurality of openings in said conveyor belt, said means for feeding including means for sucking air through said plurality of openings in said conveyor belt, and said means for feeding also including means for grasping the lowest sheet in the first stack of sheets and removing the lowest sheet from the first stack of sheets;

said means for grasping including a suction element and means for creating an air cushion between the lowest sheet in the first stack of sheets and the remainder of the first stack of sheets, said means for creating an air cushion including an air blower, said means for grasping the lowest sheet including means for supporting said first stack of sheets proximate to an edge of said first stack of sheets on both sides of an open space;

said device further including means for conveying individual sheets from the first stack of sheets away from said means for grasping.

2. A device according to claim 1, wherein:

supporting plates are disposed on opposed sides of said suction element, said suction element including means for moving said suction element vertically to create an indentation in the lowermost sheet.

3. A device according to claim 2, wherein:

said supporting plates are disposed in oblique relationship to a leading edge of the lowermost sheet.

4. A device according to claim 3 further including:

means for adjusting the separation between said supporting plates.

5. A device in accordance with claim 4 further including:

a second conveyor belt disposed in generally parallel relationship to said first conveyor belt with a finite space therebetween, said device further including a synchronously timed slider including means for moving said slider back and forth between said first and second conveyor belts, said magazine further including means for holding a second stack of sheets, said second conveyor belt supporting the second stack of sheets in said device including means for feeding the lowermost sheet from the second stack of sheets.

6. A device according to claim 3 further including:

a stack lifter capable of driving under the first stack of sheets in a movement coordinated with the motion of said suction element, said stack lifter raising the first stack of sheets adjacent to the indentation in said lowermost sheet.

7. A device according to claim 3, wherein:

said suction element is disposed proximate to the middle of the leading edge of said first stack of sheets in said apparatus further includes first and second bearing rollers supporting the first stack of sheets on respective sides of said suction element.

8. A device in accordance with claim 3, wherein:

said suction element includes a bellows and a suction cup.

9. A device in accordance with claim 3 further including:

a second conveyor belt disposed in generally parallel relationship to said first conveyor belt with a finite space therebetween, said device further including a synchronously timed slider including means for moving said slider back and forth between said first and second conveyor belts, said magazine further including means for holding a second stack of sheets, said second conveyor belt supporting the second stack of sheets in said device including means for feeding the lowermost sheet from the second stack of sheets.

10. A device according to claim 2 further including:

means for adjusting the separation between said supporting plates.

11. A device according to claim 10 further including:

a stack lifter capable of driving under the first stack of sheets in a movement coordinated with the motion of said suction element, said stack lifter raising the first stack of sheets adjacent to the indentation in said lowermost sheet.

12. A device according to claim 10, wherein:

said suction element is disposed proximate to the middle of the leading edge of said first stack of sheets in said apparatus further includes first and second bearing rollers supporting the first stack of sheets on respective sides of said suction element.

13. A device in accordance with claim 10, wherein:

said suction element includes a bellows and a suction cup.

14. A device in accordance with claim 10 further including:

a second conveyor belt disposed in generally parallel relationship to said first conveyor belt with a finite space therebetween, said device further including a synchronously timed slider including means for moving said slider back and forth between said first and second conveyor belts, said magazine further including means for holding a second stack of sheets, said second conveyor belt supporting the second stack of sheets in said device including means for feeding the lowermost sheet from the second stack of sheets.

15. A device according to claim 2 further including:

a stack lifter capable of driving under the first stack of sheets in a movement coordinated with the motion of said suction element, said stack lifter raising the first stack of sheets adjacent to the indentation in said lowermost sheet.

16. A device according to claim 2, wherein:

said suction element is disposed proximate to the middle of the leading edge of said first stack of sheets in said apparatus further includes first and second bearing rollers supporting the first stack of sheets on respective sides of said suction element.

17. A device in accordance with claim 2, wherein:

said suction element includes a bellows and a suction cup.

18. A device in accordance with claim 2 further including:

a second conveyor belt disposed in generally parallel relationship to said first conveyor belt with a finite space therebetween, said device further including a synchronously timed slider including means for moving said slider back and forth between said first and second conveyor belts, said magazine further including means for holding a second stack of sheets, said second conveyor belt supporting the second stack of sheets in said device including means for feeding the lowermost sheet from the second stack of sheets.

19. A device according to claim 1 further including:

a stack lifter capable of driving under the first stack of sheets in a movement coordinated with the motion of said suction element, said stack lifter raising the first stack of sheets proximate to send suction element.

20. A device according to claim 1, wherein:

said suction element is disposed proximate to the middle of the leading edge of said first stack of sheets in said apparatus further includes first and second bearing rollers supporting the first stack of sheets on respective sides of said suction element.

21. A device according to claim 1, wherein:

said magazine includes means for adjusting to accommodate sheets of various sizes.

22. A device in accordance with claim 1, wherein:

said suction element includes a bellows and a suction cup.

23. A device in accordance with claim 11 further including:

a second conveyor belt disposed in generally parallel relationship to said first conveyor belt with a finite space therebetween, said device further including a synchronously timed slider including means for moving said slider back and forth between said first and second conveyor belts, said magazine further including means for holding a second stack of sheets, said second conveyor belt supporting the second stack of sheets in said device including means for feeding the lowermost sheet from the second stack of sheets.

24. A device in accordance with claim 23 further including:

a plurality of support rollers for supporting said sheets.

* * * * *